US006165545A

United States Patent [19]

Moody

[11] Patent Number: 6,165,545

[45] **Date of Patent: *Dec. 26, 2000**

[54] AFTER-TREATMENT METHOD FOR IMPARTING OIL-AND WATER-REPELLENCY TO FABRIC

[75] Inventor: Richard J. Moody, Wilmington, Del.

[73] Assignee: Ricard J. Moody, Wilmington, Del.

[ * ] Notice: This patent is subject to a terminal disclaimer.

[21] Appl. No.: 09/372,492

[22] Filed: Aug. 12, 1999

[51] Int. Cl.[7] ..... B32B 35/00; B05D 1/18; B05D 3/02

[52] U.S. Cl. ..... 427/140; 427/430.1; 427/393.4

[58] Field of Search ..... 427/140, 430.1, 427/393.4; 428/351

[56] References Cited

U.S. PATENT DOCUMENTS

| | | | |
|---|---|---|---|
| 2,803,615 | 8/1957 | Albrecht et al. | 524/805 |
| 3,628,997 | 12/1971 | Elkind et al. . | |
| 3,995,085 | 11/1976 | McCown | 428/262 |
| 4,013,627 | 3/1977 | Temple | 526/245 |
| 4,439,473 | 3/1984 | Lippman | 428/90 |
| 4,564,561 | 1/1986 | Lore et al. | 428/422 |
| 4,595,518 | 6/1986 | Raynolds et al. . | |
| 5,047,065 | 9/1991 | Vogel et al. | 8/115.6 |
| 5,212,272 | 5/1993 | Sargent et al. | 526/317.1 |
| 5,539,072 | 7/1996 | Wu | 526/304 |
| 5,629,376 | 5/1997 | Sargent et al. | 524/745 |
| 5,670,469 | 9/1997 | Dingus et al. | 510/274 |
| 5,725,789 | 3/1998 | Huber et al. | 252/8.62 |

FOREIGN PATENT DOCUMENTS

| | | |
|---|---|---|
| 19516907 | 11/1996 | Germany . |
| 62-215074 | 9/1987 | Japan . |

OTHER PUBLICATIONS

Technical information and Material Safety Data Sheets for ZONYL® 6991, DuPont Specialty Chemicals, Oct. 3, 1994.

MeNeil, Text Res. J. (1990, 60(4), pp. 244–245. Abstract.

*Primary Examiner*—Shrive Beck
*Assistant Examiner*—Jennifer Kolb
*Attorney, Agent, or Firm*—Connolly Bove Lodge & Hutz LLP

[57] ABSTRACT

A method is provided for after-treating fabric with a fluoroacrylate emulsion by immersion, typically under poorly-controlled conditions (e.g. field conditions), and a second embodiment of this method is provided for treating large, previously manufactured items comprising fabric (e.g. upholstered furniture, tents, awnings, and the like) with an aerosol spray containing micrometer or submicrometer-sized droplets of a diluted version of the fluoroacrylate emulsion. In both embodiments, the fluoroacrylate emulsion contains, dispersed therein with the aid of a surfactant system containing an amphoteric surfactant, essentially a single particulate fluoroacrylate copolymer having repeating units of the formulas I and II (I)

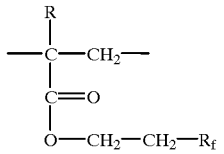

(II)

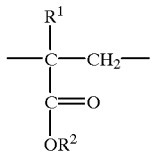

wherein $R_f$ is a fluorinated alkyl radical; R and $R^1$ are hydrogen or alkyl; and $R^2$ is hydrogen or substituted or unsubstituted alkyl. The aqueous dispersion further contains, in addition to the surfactant system, a minor amount of polar organic liquid. In the first embodiment, drying under heat is optional and in any event can be carried out at temperatures below 55° C. In the second embodiment, drying under heat is highly impractical but is also unnecessary.

7 Claims, No Drawings

AFTER-TREATMENT METHOD FOR IMPARTING OIL-AND WATER-REPELLENCY TO FABRIC

CROSS REFERENCE TO RELATED APPLICATION

The present applicant also filed copending U.S. application Ser. No. 09/160,019 on Sep. 24, 1998. The subject matter of the Ser. No. 09/160,019 application is related to the subject matter of the present application. The disclosure of the Ser. No. 09/160,019 application is hereby incorporated by reference.

FIELD OF THE INVENTION

This invention relates to a composition for after-treating a fluorochemical-treated fabric to restore or enhance its hydrophobic and oleophobic properties after the fabric has been subjected to extensive use (including exposure to outdoor conditions), and/or cleaning. An aspect of this invention relates to fluorochemical after-treatments of fabrics which have been pre-treated for water repellency during manufacture but which have lost some of their water repellency during use (e.g. under adverse weather conditions) or during dry cleaning or laundering. Still another aspect of this invention relates to methods for treating fabrics with a fluorochemical in circumstances in which a source of heat is not available or is inconvenient to use.

DESCRIPTION OF THE PRIOR ART

It has long been known that certain fluorochemicals impart both oil- and water-repellency to fabric. The fluorochemical treatment is typically carried out during a manufacturing stage (e.g. in a textile mill), but most fluorochemical treatments are subject to loss of efficacy due to dry cleaning, laundering, or use. The efficacy of the original fluorochemical treatment can be restored, at least in part, by after-treatments. But because of concerns regarding effects of volatile organic solvents or diluents on the environment, aqueous dispersions of fluoropolymers (which contain at most only minor amounts of organic liquids) have come into widespread use for such after-treatments. Typically, the aqueous (as opposed to solvent-based) after-treatments require a "curing" step, generally a heat treatment, in many cases heating the treated material to a temperature of at least about 60° C., in some cases up to as high as 150° C. or more, depending upon, for example, the particle size of the dispersed fluoropolymer, the surfactant system used to keep the fluorochemical particles dispersed (and to assist in exhausting the fluoropolymer onto the fabric being treated), and, perhaps most important, the melting or softening behavior of the fluoropolymer under mildly elevated temperature conditions. Commonly available clothes dryers for home use can provide drying temperatures up to almost 75° C., but special equipment is needed for hotter drying environments.

Single fluoroacrylate polymers and complex fluoropolymer mixtures have been developed which, in aqueous dispersion form, can be applied to a fabric and then air dried and/or cured. Typically, these aqueous dispersions contain fluoroacrylate polymers of small particle size and low softening points or melting points. In addition, the polymer and/or the surfactant system can be designed to facilitate more lasting deposition on the fabric under mild conditions.

Fluorochemical treatments which "cure" under normal ambient conditions (e.g. air drying at room temperature) have special importance for after-treatments in circumstances in which a source of heat (such as a clothes dryer) is not readily available. An example of such an after-treatment is the restoration or enhancement of the properties of previously waterproofed garments, blankets, tents, awnings, upholstery, and other fabric items under field conditions (e.g. during military operations), where the only laundering facilities available may be an essentially stationary or temporary wash tank such as a large drum filled with wash water and fluorochemical treatment medium in which the item can be immersed—provided that it is small enough. Awnings, tents, upholstered furniture, and other large, fully fabricated items would normally have to be sprayed with a portable sprayer, and the ambient temperature may not be warm enough for a good cure. Clothes-drying capabilities in these situations may amount to nothing more than a clothesline and/or a portable hair dryer.

To be effective in this invention, a fluorochemical treatment ought to be very rugged; that is, the treatment is preferably insensitive to adverse or uncontrolled conditions (e.g. uncontrolled pH in the wash water and uncontrolled ambient temperature or humidity). Textile mill treatments, where conditions can be controlled with considerable precision, can be far more sensitive to the treatment conditions and still be effective.

The patent literature relating to fluorochemical treatments of fibrous substrates has become fairly extensive since fluoropolymers specifically for this purpose were developed in the 1950's. Illustrative references include the following U.S. Pat. No. 4,564,561 (Lore et al), issued Jan. 14, 1986, U.S. Pat No. 4,595,518 (Raynolds et al), issued Jun. 17, 1986, U.S. Pat. No. 4,439,473 (Lippman), issued Mar.27, 1984, U.S. Pat. No. 5,212,272 and U.S. Pat. No. 5,629,376 (Sargent), issued May 18, 1993 and May 13, 1997, respectively, and U.S. Pat. No. 5,539,072 (Wu), issued Jul. 23, 1996.

SUMMARY OF THE INVENTION

It has now been found that a fabric which has been waterproofed during its manufacture but has suffered some loss of the waterproofing effect through cleaning and/or use can be substantially restored to its original hydrophobic properties (or even enhanced in hydrophobicity) by an aqueous fluoroacrylate treatment that does not require heat for drying and/or curing (heating to temperatures higher than 55° C. appears to confer no additional benefit) and that does not require a mixture of polymers in the treatment medium.

It has also been found that substantially the same aqueous fluoroacrylate after-treatment technology can be applied as an aerosol spray capable of air-drying on large manufactured items comprising fabric—items that are too bulky to be immersed in a wash tank. Typically, these items have also been pre-treated with a fluorochemical, but the spray-application embodiment of this invention can also be employed to provide an initial waterproofing and/or oil-repellent treatment if the manufacturer did not apply any fluorochemical.

Thus, one embodiment of the invention is a method involving the following steps.

First, preparing the fabric-treating aqueous medium by adding to a major amount of wash water a minor amount of an aqueous dispersion containing, dispersed therein, essentially a single particulate fluoroacrylate copolymer having repeating units of the formula:

(I)

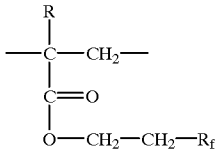

and (II)

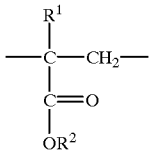

wherein $R_f$ is a fluorinated alkyl radical having 4 to 16 carbon atoms (preferably, $R_f$ is a linear, perfluorinated radical having, on average, about 8 carbon atoms), R is hydrogen or a $C_1$–$C_4$-alkyl radical;

$R^1$ is the same as or different from R but is also hydrogen or a $C_1$–$C_4$-alkyl radical; and $R^2$ is hydrogen or a $C_1$–$C_8$-alkyl radical which is unsubstituted or substituted, e.g. substituted by hydroxyl, $C_1$–$C_4$-alkoxy, or an amino group.

In addition to the above-described fluoroacrylate copolymer, the aqueous dispersion also contains a minor amount of a multi-purpose surfactant system (this system assures a fine, stable dispersion of the copolymer and also assists in depositing the copolymer on the fabric). The surfactant system contains at least one amphoteric surfactant and preferably a nonionic surfactant. A cationic surfactant can also be present. The aqueous dispersion further contains a minor amount of polar organic liquid dissolved in the aqueous medium. It is preferred that the degree of linearity, the weight-average molecular weight ($M_W$), and the number-average molecular weight ($M_n$) of the fluoroacrylate polymer be selected so that the softening or melting point of the polymer (typically the polymer is sufficiently crystalline to have a meaningful melting point) is not significantly greater than 60° C. and is preferably below that temperature.

Second, immersing a previously waterproofed fabric (the fabric item has typically been waterproofed during a stage of its manufacture) in a treatment zone containing the fabric-treating aqueous medium for a time sufficient to deposit the aqueous dispersion on the fabric.

Third, drying the thus-treated fabric at a temperature below 55° C., e.g. normal ambient conditions (such as 20 to 30° C. /normal atmospheric pressure), until the waterproofing of the fabric is restored or enhanced. No further drying is needed to obtain or preserve this result. Heating to temperatures about 55° C. does not appear to provide significant further improvement in waterproofing or oil-repellent properties.

In another embodiment of the invention, a manufactured item comprising fabric (e.g. upholstered furniture) which is too large to be immersed in a wash tank is sprayed with a portable sprayer and permitted to dry or cure under normal ambient conditions The portable spray device is preferably provided with a small orifice (e.g. 0.05 to 0.5 mm in diameter) and a source of gas pressure to break up the spray into tiny dispersoid (micrometer- or submicrometer-sized) droplets which form an aerosol. The sprayer dispenses an aqueous dispersion of the type described above. The aqueous dispersion is typically not dispensed in full strength and can be effective after being substantially diluted.

A typical aqueous dispersion useful in the method of this invention (prior to any dilution) consists essentially of:

a. 50 to 85% by weight of a continuous aqueous phase, b. 1 to 10% (preferably 2 to 10%) by weight of a polar organic liquid (e.g. a protic solvent such as a diol) dissolved in the aqueous phase, and c. dispersed in the aqueous phase as the dispersed ("oil-in-water") phase, 15 to 40% by weight of the essentially single particulate fluoroacrylate polymer, and d. the surfactant system.

The method of this invention restores or enhances oil-repellent properties as well.

DETAILED DESCRIPTION

As will be apparent from the foregoing discussion of the prior art, the skilled artisan can choose from a wide variety of well-controlled waterproofing and/or oil-repellent treatments in the context of fabric manufacturing. The equipment in a textile mill can include pad baths and other baths suitable for either continuous or batch application, high-pressure spray devices or spray devices which produce a coarse spray pattern, and various devices for applying controlled amounts of heat or other controlled radiant energy, not to mention a broad choice of fluorochemicals. Even solvent-based fluorochemicals can be used if the mill has an adequate solvent recovery system.

But once a fabric item has left the mill and has been put to use, the options become very limited. The method of application, for example, can oftentimes be limited to immersion in a wash tank or to spraying with a portable spray device (e.g an aerosol sprayer), where the available applied pressure (provided by compressed air or a compressed propellent) is not more than 70 or 75 p.s.i.g. (≦500 KPa), more typically 10 to 40 p.s.i.g. (70 to 280 KPa). To create an aerosol, the aqueous dispersion, typically diluted, is dispensed as micrometer or submicrometer-sized droplets. Under field conditions, heat curing can be cumbersome at best and totally impractical at worst. The treatment chemical should be in the form of an aqueous dispersion, although minor amounts of organic solvents or diluents in the dispersion can certainly be tolerated. And, although this invention is not bound by any theory, it is believed that the aqueous dispersion—to provide good results when drying and/or curing at atmospheric pressure and temperatures below 55° C.—ought to be as simple as possible. That is, it would appear to be ideal to be able to employ a surfactant system and a fluoropolymer which is not dependent upon sophisticated pH adjustments in order to achieve sufficient deposition of fluoropolymer; moreover, it would appear to be ideal to accomplish the goals of the after treatment with a dispersion containing essentially a single polymer rather than a complex mixture of polymers. However, the use of pH-adjusting agents (e.g. carboxylic acids) is permissible in this invention.

Although this invention is not bound by any theory, it is presently believed that the less the complexity of the aqueous dispersion, the more rugged it will be. Simplicity in the dispersed fluoropolymer can be provided by building all of the desired polymer properties into a single polymer structure via copolymerization (if necessary, the copolymer structure can be a terpolymer, quaterpolymer, etc.). Prior art mill treatments can utilize complex treatment media which can contain as many as three or four different polymers, pre-dispersed in water and then combined to form a single aqueous medium. These complex fluorochemical systems are not suitable for use in this invention.

Thus, the above-described repeating units of the formula II—as well as those of formula I—play a role in the properties of the fluoroacrylate. For example, the hydrophobe/hydrophile balance of the fluoroacrylate can be modified in the direction of better compatibility with water by copolymerizing the fluorinated monomer (compound III, described below) with a monomer mixture containing at least some 2-hydroxyethylmethacrylate or 2-hydroxyethylacrylate. Polyelectrolyte properties can be introduced by including some acrylic acid in the monomer mixture. Cationic sites on the polymer chain can be provided with tertiary amine-substituted acrylic monomers, and so forth.

To illustrate a reason why simplicity of the dispersed phase is preferred, under field conditions there is, at best, poor control over the quality of the water used to dilute the treatment medium and wash the fabric item. Uncontrolled variations in the pH of the water may interfere with the performance of a complex mixture that includes, for example, amphoteric polymers which can become ineffective as treatment agents if the pH is too high or too low. (Amphoteric surfactants are permissible in this invention, however.) In the field, the fluoroacrylate polymer itself may be subject to undesirable chemical changes if some of the repeating units of the polymer contain amido, carbamate or urethane (—NH—CO—O—), sulfo, or sulfone groups or the like.

Present experience with this invention indicates that a modest amount of the aqueous dispersion selected according to this invention, when added to relatively large amount of wash water, can be deposited on the fiber of the fabric in a sufficient amount to restore substantially the manufacturer's factory treatment for oleophobic and/or hydrophobic properties. This experience indicates further that an aerosol spray can containing an appropriate concentration of the aqueous dispersion can deliver enough fluoroacrylate polymer to a fabric so that, after drying under normal ambient conditions, the treated fabric has significantly enhanced oleophobic and/or hydrophobic properties. The performance of the method of this invention compares well with methods which require curing at temperatures as high as 60 to 75° C. or even higher.

The Aqueous Dispersion

The aqueous dispersion selected for use in this invention contains a fluoroacrylate polymer that is ordinarily essentially free of N-containing groups (e.g. amido or urethane radicals, linkages, or bridges) and S-containing groups (e.g. sulfonate or sulfate anions "built in" to the polymer chain, sulfoxide or sulfone radicals, bridges, or linkages). However, if cationic sites on the fluoroacrylate polymer are desired, amino nitrogens can be introduced, so that the polymer will contain repeating units derived from N-substituted or N,N-disubstituted aminoethylmethacrylates or similar monomers which can provide cationic sites.

The preferred fluoroacrylate monomer can be synthesized by the classic telomerization method, using free-radical initiation and tetrafluoroethylene as the starting material. The result of this synthesis is an essentially linear, saturated perfluorocarbon chain having, say, 6 to 16 carbon atoms (a 3- to 8-unit tetrafluoroethylene telomer). The telomerization process can be sufficiently well-controlled to provide, on average, a certain number of carbon atoms, e.g. about 8, with an omega-halogen such as iodine; that is, the telomer can be substantially pure perfluorooctyl iodide. The $C_8F_{17}I$ telomer can be converted to perfluorooctyl-ethanol, which is suitable for reaction with acrylic monomers such as acrylic acid or methacrylic acid. The result is a fluoroacrylic monomer of the formula III $$R_f—CH_2CH_2—O—(CO)—C(R)=CH_2 \quad \text{(III).}$$

In its broadest aspect the term "acrylic monomer" can refer either to a co-reactant for the perfluoroalkyl-ethanol or a co-monomer for the fluoroacrylic monomer of formula III. Thus, the term "acrylic monomer" is intended to include monomers of formula IV:

$$R^2—O—(CO)—C(R^1)=CH_2 \quad \text{(IV),}$$

e.g. alkyl methacrylates, alkyl acrylates, 2-substituted ethyl acrylates or methacrylates, and the like.

For an advantageous balance of properties, monomer III and monomer IV are copolymerized, resulting in a polymer containing repeating units of the formulas I and II:

(I)

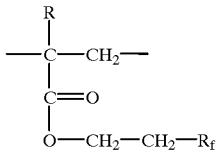

(II)

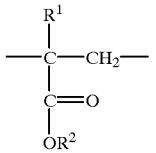

wherein $R_f$ is a fluorinated alkyl radical having 4 to 16 (preferably, on average, about 8) carbon atoms;

R is hydrogen or a $C_1$–$C_4$-alkyl radical, e.g. methyl;

$R^1$ is the same as or different from R but is also hydrogen or a $C_1$–$C_4$-alkyl radical; and $R^2$ is hydrogen or a $C_1$–$C_8$-alkyl radical which is unsubstituted, or substituted by hydroxyl, $C_1$–$C_4$-alkoxy, etc., e.g. 2-hydroxyethylmethacrylate or 2-hydroxyethylacrylate.

Because the fluoroacrylate copolymer or heteropolymer (bipolymer, terpolymer, quaterpolymer, etc.) is the dispersed phase in an aqueous system (stated another way, it is the "oil" phase of an oil-in-water emulsion or dispersion), the fluoroacrylate copolymer is in the form of tiny particles, colloidal or nearly colloidal particles (e.g. 0.01 to 1, more preferably 0.01 to 0.1 $\mu$m) being normally preferred. The fluoroacrylate copolymer is prepared by emulsification polymerization in the presence of a minor amount (typically not more than 5 weight-%, more typically $\leqq 1$ weight-%, based on the weight of the resulting emulsion) of a surfactant system. The surfactant system serves more than one purpose. It helps protect against coagulation during emulsion polymerization; it helps to provide a stably dispersed copolymer, and it assists the method of this invention by facilitating deposition onto the fiber of the fabric being after-treated.

Nonionic surfactants useful in this surfactant system generally contain one or more $C_2$–$C_3$-oxyalkylene units, and oxyethylene units preferably predominate. The oxyethylene chains can be obtained by interaction of mono- or polyhydroxy compounds with ethylene oxide. Sorbitol and its anhydrides (sorbitans) are typically employed as polyhydroxy compounds. Sorbitan esters also have surface-active properties.

Cationic surfactants generally contain a tertiary or quaternary nitrogen and preferably are quaternary ammonium salts or, less typically, amine salts. The N-substituted radicals can be aliphatic (e.g. alkyl groups) or oxyalkylated aliphatic groups. Amphoteric surfactants have a structure or structures which can be anionic or cationic, depending on the pH of the aqueous medium. For example, these surfactants can have both carboxyl/carboxylate or sulfonyl/sulfonate and amine/protonated amine groups or can be cyclic imido compounds with a urea structure such as fatty imidazolines.

An organic coalescent/stabilization liquid is also present in a minor amount (1 to 20 weight-%, preferably 1 to 10 weight-%) during the emulsion polymerization and remains in the resulting aqueous dispersion, dissolved in the aqueous medium. Preferred organic solvents used as coalescent/stabilization liquids are protic, e.g. aliphatic diols, triols, etc. Glycols such as dipropylene glycol and especially propylene glycol are particularly preferred.

Prior to dilution, the solids content of the preferred aqueous dispersion ranges from about 15 to about 40 weight-%, more preferably 20 to 30 weight-%. The dilution can take place in either of two ways. In the wash-tank embodiment of this invention, the aqueous dispersion is diluted very substantially through addition to the wash water. In the spray-application embodiment of this invention, the aqueous dispersion is preferably diluted before being introduced into the sprayer.

The preferred commercially-available form of the aqueous dispersion is REPEARL F-3700 fluoroacrylate copolymer emulsion, a product of Asahi Glass, available from Mitsubishi International Corporation, New York, N.Y. This product contains 7 weight-% propylene glycol, 20 weight-% fluoroacrylate copolymer emulsion, and 73 weight-% water. The amount of surfactant system is no greater than about 1 weight-% and hence has no substantial effect upon the proportions given above.

The Treatment Medium

As indicated previously, the treatment (and washing) medium is obtained by adding a small amount of the aqueous dispersion to a tank of water large enough to accommodate immersion of the fabric item or items. It presently appears that the most effective use of this treatment medium relates to restoring or enhancing the waterproofing of items of clothing. After the clothes have been treated, they can be hung up to dry or otherwise dried at normal ambient temperatures. If a clothes dryer is available, the "delicate" setting can be used (≦49° C).

In addition to containing the aqueous dispersion, the treatment medium can contain cleaning or laundering compositions, e.g. soap, a detergent, a bleaching agent, or a fabric softener.

The dilution of the aqueous dispersion resulting from the addition to the large amount of water (e.g. the water in a wash tank) generally results in a washing and treating medium containing from about 0.25% to about 15% by weight of the aqueous dispersion. For military or other field applications, large concentrations of the dispersion in the treatment medium (e.g. 5 to 15% by weight) are desirable; the cost of the aqueous dispersion can be a minor concern, and a very high degree of waterproofing is the primary consideration. Under more conventional clothes-washing conditions, cost can be important. Good results are obtained with a wash tank containing about 1 to about 3% aqueous dispersion.

The resulting loading on the fabric is similar numerically to the concentrations of aqueous dispersion in the wash tank. Parts per hundred (phr) ratios provide a particularly convenient way to measure loading. In this context, "parts per hundred" refers to the parts by weight of aqueous dispersion added to the treatment medium in the wash tank with respect to 100 parts by weight of fabric material to be treated, e.g. 2 to 4 parts by weight of aqueous dispersion per hundred parts by weight of fabric (2 to 4 phr). Loadings of at least about 0.25 phr are preferred. Loadings in excess of 5 to 6 phr are generally too costly to be practical (at least in conventional laundering) and appear to provide no improvement over loadings of 3 to 4 phr or less. The most preferred loadings range from 1.0 to 3.5 phr.

An alternative form of treatment medium is dispensable from a portable spray device such as a compressed-air sprayer or a conventional aerosol spray package provided with a spray valve and a propellant. For convenience, aerosol packages (e.g. cans) containing conventional non-CFC propellants (e.g volatile hydrocarbons, fluorinated $C_1$–$C_4$ alkanes, nitrogen, carbon dioxide, etc.) under ≦500 K Pa gauge pressure are desirable. Regardless of the type of portable sprayer used, an aerosol (extremely fine droplets of the aqueous dispersion mixed with a gas such as air) is desirable, whereas coarse sprays are not preferred. The fine droplets comprise particles of fluoroacrylate polymer surrounded by the aqueous dispersing medium. The polymer particles are far too small to clog conventional aerosol valves having orifices as large as 0.1 to 0.5 mm.

This alternative form of treatment medium preferably comprises the aqueous dispersion (e.g. REPEARL F-3700) diluted to a strength of about 2 to 15% by weight. The diluted aqueous dispersion can, for example, be stored in the tank of a sprayer or inside an aerosol package.

When this sprayable form of treatment medium is employed, the only conditions for drying and/or curing typically available are the environmental conditions, which can if necessary be outdoor conditions and would in that case be completely uncontrolled.

The Fabric Substrate To Be Treated

The previously waterproofed fabric items treated according to this invention can be woven or nonwoven. Suitable nonwoven materials include felts, air-laid batts, and similar materials prepared from staple fiber or microfibers. The fibers can be natural (e.g. cellulosic or proteinaceous) or synthetic (regenerated cellulose, chemically modified cellulose, or wholly synthetic organic polymer fibers made from polymers such as the polyamides, polyesters, polyolefins, partially hydrolyzed polyvinyl acetates, other vinyl polymers, etc.). The invention is perhaps most useful for restoring or enhancing the waterproofing of garments such as shirts, coats or jackets, trousers, and hats, especially all-weather and military garments, and for treating large manufactured items which cannot conveniently be immersed in a wash tank, e.g. upholstered furniture, tents, and awnings.

The principle and practice of this invention is illustrated by the following non-limiting Examples.

In these Examples, three different tests for the efficacy of the treatments were used.

The Water Repellency Test (Aqueous Liquid "Hold Out" Ability)

This test, 3M Water Repellency Test II, also known as the "drop test" rates the ability of the treated fabric to "hold out" water/alcohol mixtures containing up to 100% alcohol. A test liquid is "held out" when the surface tension of at least two of three test drops retain the coherency of the drops for at least 10 seconds. Coherent drops assume a spherical or hemispherical shape rather than being absorbed into the fabric. The test is described in detail in copending application Ser. No. 09/160,019. The rating is on a scale of 1 to 10, based on the composition of the test liquid which is held out; when only 90% water/10% i-propyl alcohol is held out, the treated fabric sample is given a rating of 1, and when 100% i-propyl alcohol is held out, the sample is given a rating of 10. Pure water has a surface tension of 72.8 dynes/cm at 20° C., and when the water content is decreased by only 10% (i.e. 90% water/10% i-propyl alcohol), the surface tension drops dramatically—to 39.0 dynes/cm at 20° C. All of the other water/i-propyl alcohol mixtures (beginning with 80% water/20% i-propyl alcohol) have lower surface tension values, and isopropyl alcohol itself has a surface tension at 20° C. of only 21.7 dynes/cm. Thus, the effect of this test is to rate samples based upon drops of a test liquid of the lowest surface tension which retain their coherent form for the required period of time.

Spray Test—AATCC Test Method 22-1989

The Spray Test measures fabric resistance to wetting by water. According to the test procedure, a specified amount of water is sprayed over the fabric's surface, and the pattern of wetting indicates the fabric's ability to repel water. The lowest rating is 0 (poor resistance) and the highest is 100 (excellent resistance).

Oil Repellency Test

Oil repellency is determined by reference to AATCC Test Method 118-1992 Oil Repellency: Hydrocarbon Resistance Test. This test determines a fabric's resistance to wetting by oily materials. A variety of oils with different surface tensions are introduced to the fabric. The oily liquid with the highest surface tension that is held out by the fabric determines the test rating. The higher the number attained in this test, the better the fabric's ability to hold out oily substances.

The purpose of the following Examples is to demonstrate that fabrics immersed in a treatment medium of the method of this invention and then dried at room temperature perform approximately as well, in these three tests, as fabric which has been immersed and then dried ("cured") with heat at a temperature above 55° C. (e.g. 60° C.).

To illustrate this performance more clearly, in Parts A and B of each Example, two different aqueous dispersions were immersed and dried under heat: an aqueous dispersion selected in accordance with this invention (PROTEX$^{AD}$, a product of M&M Technologies, Inc., containing REPEARL F-3700, a product of Asahi Glass) and an aqueous dispersion selected in accordance with application Ser. No. 09/160,019 (PROTEX©, a product of M&M Technologies, Inc., containing REPEARL F-92, also a product of Asahi Glass). In Part C of each Example, the PROTEX$^{AD}$-treated samples were dried at room temperature and were given no heat treatment. A PROTEX© treatment is intended for heat-drying only, whereas a PROTEX$^{AD}$ treatment can either be dried at 45 to 75° C. (preferably below 55° C.) or at normal ambient temperatures.

EXAMPLE 1

Water Repellency Test

Part A: In this Part of Example 1, cotton/polyester ("C/PE") and 100% polyester ("PE") fabric samples with depleted or negligible waterproofing and oil-repellent properties were immersed in a bath or tank containing a large volume of water and PROTEX© fluoroacrylate copolymer emulsion containing REPEARL F-92, a product of Asahi Glass. The PROTEX© emulsion was added to the water in the tank in five different quantities to provide a series of percentages of emulsion, based on the weight of the liquid in the tank, ranging form 0.25% to 3%. After removal from the tank, the samples were then dried at a standard dryer setting (at least about 60° C.) to "cure" the deposits of fluoroacrylate copolymer emulsoid particles on the fabric.

Three tests were carried out at each percentage of emulsion. The pH and the density of the medium were varied slightly from test to test but appeared to have no significant effect upon the results (pH ranged from 2.82 to 3, and density ranged from 1.0 to 1.026).

Each numerical rating given in the following Table (Table I) reflects the range of values obtained in the three tests.

Part B: In this Part of Example 1, cotton/polyester ("C/PE") and 100% polyester ("PE") fabric samples with depleted or negligible waterproofing and oil-repellent properties were immersed in a bath or tank containing a large volume of water and PROTEX$^{AD}$ fluoroacrylate copolymer emulsion, a product of M&M Technologies, Inc. (containing REPEARL F-3700 from Asahi Glass). The PROTEX$^{AD}$ emulsion was added in five different amounts to provide another series of percentages of emulsion, based on the weight of the liquid in the tank, ranging form 0.25% to 3%. The immersed samples were dried at a standard dryer setting (≧60° C.).

Two tests were carried out at each percentage of emulsion. Each numerical rating given in the following Table (Table 1) reflects the range of values obtained in the these two tests. In the event that the two tests differed by more than one rating unit, e.g. if test no. 1 were to give a rating of 5 and test no. 2 were to give a rating of 7, the range of values would be expressed as "5 to 7".

Part C: In this Part of Example 1, cotton/polyester ("C/PE") and 100% polyester ("PE") fabric samples with depleted or negligible waterproofing and oil-repellent properties were immersed in a bath or tank containing a large volume of water and PROTEX$^{AD}$ fluoroacrylate copolymer emulsion (see Part B), but this time the fabric samples were not dried under heat; they were permitted to dry at room temperature. The PROTEX$^{AD}$ emulsion was added as before to provide concentrations of emulsion ranging form 0.25% to 3%.

Two tests were carried out at each percentage. Each numerical rating given in the following Table (Table I) reflects the range of values obtained in the these two tests. In the event that the two tests differed by more than one rating unit, the reporting procedure described in Part B was employed.

TABLE I

WATER REPELLENCY TEST RESULTS (Example 1)

| Applied Amount* (%) | Fabric | Ex. 1, Part A (3 Samples) | Ex. 1, Part B (2 Samples) | Ex. 1, Part C (No Heat, 2 Samples) |
|---|---|---|---|---|
| 0.25 | C/PE | 3 to 4 | 3 to 4 | 3 to 4 |
| 0.50 | C/PE | 4 to 5 | 5 | 5 |
| 1.0 | C/PE | 7 | 6 to 7 | 7 |
| 1.5 | C/PE | 8 to 9 | 7 to 9 | 9 |
| 3 | C/PE | 9 to 10 | 9 to 10 | 10 |
| 0.25 | PE | 6 | 6 to 7 | 6 to 7 |
| .50 | PE | 8 | 8 to 9 | 7 to 8 |
| 1.0 | PE | 9 | 10 | 9 to 10 |
| 1.5 | PE | 10 | 10 | 10 |
| 3 | PE | 10 | 10 | 10 |

*Based on the total weight of the treatment medium.

EXAMPLE 2

Spray Test Results

Part A: In this Part of Example 2, cotton/polyester ("C/PE") and 100% polyester ("PE") fabric samples with depleted or negligible waterproofing and oil-repellent properties were given the Spray Test. The fabric samples were first treated as in Example 1, Part A. The emulsion levels in the treatment tank were the same as in Example 1, i.e. based on the weight of the liquid in the tank, these levels ranged form 0.25% to 3%. The drying temperature was standard, as in Part A of Example 1.

Three tests were carried out at each percentage of emulsion. Each numerical rating given in the following Table (Table II) reflects the range of values obtained in the three tests.

Part B: In this Part of Example 2, cotton/polyester ("C/PE") and 100% polyester ("PE") fabric samples with depleted or negligible waterproofing and oil-repellent properties were immersed in a bath or tank containing a large volume of water and PROTEX$^{AD}$ fluoroacrylate copolymer emulsion (see Example 1, Parts B and C). The PROTEX$^{AD}$ emulsion was added, as before, in increasing increments of concentration in the treatment medium in the tank (concentrations ranging form 0.25% to 3%). The drying temperature was determined by the standard dryer setting, as in Parts A and B of Example 1.

Two tests were carried out at each percentage of emulsion. Each numerical rating given in the following Table (Table II) reflects the range of values obtained in the these two tests.

Part C: In this Part of Example 2, cotton/polyester ("C/PE") and 100% polyester ("PE") fabric samples with depleted or negligible waterproofing and oil-repellent properties were immersed in a bath or tank containing a large volume of water and PROTEX$^{AD}$ fluoroacrylate copolymer emulsion (see Example 1, Parts B and C), but this time the fabric samples were not dried under heat; they were permitted to dry at room temperature as in Part C of Example 1. The PROTEX$^{AD}$ emulsion was added to the treatment medium in increments, as before (0.25% to 3%).

Two tests were carried out at each percentage. Each numerical rating given in the following Table (Table II) reflects the range of values obtained in the these two tests.

TABLE II

SPRAY TEST RESULTS (Example 2)

| Applied Amount** (%) | Fabric | Ex. 2, Part A (3 Samples) | Ex. 2, Part B (2 Samples) | Ex. 2, Part C No Heat, 2 Samples) |
|---|---|---|---|---|
| 0.25 | C/PE | 50 to 80 | 0 to 50 | 0 |
| 0.50 | C/PE | 70 to 80 | 50 to 70 | 50 |
| 1.0 | C/PE | 80 to 90 | 70 to 80 | 50 |
| 1.5 | C/PE | 90 to 100 | 90 | 70 |
| 3 | C/PE | 100 | 100 | 70 |
| 0.25 | PE | 80 to 90 | 70 | 50 |
| 0.50 | PE | 90 to 100 | 80 | 50 to 70 |
| 1.0 | PE | 100 | 90 | 70 to 80 |
| 1.5 | PE | 100 | 100 | 70 to 80 |
| 3 | PE | 100 | 100 | 80 to 90 |

**See Table I.

EXAMPLE 3

Oil Repllency Test

Part A: In this Part of Example 2, cotton/polyester ("C/PE") and 100% polyester ("PE") fabric samples with depleted or negligible waterproofing and oil-repellent properties were given the Oil Repellency Test, AATCC Test Method 118-1992. The fabric samples were first treated as in Example 1, Part A. The emulsion levels in the treatment tank were the same as in Example 1, i.e. based on the weight of the liquid in the tank, these levels ranged form 0.25% to 3%. The drying temperature was standard, as in Part A of Example 1.

Three tests were carried out at each percentage of emulsion. Each numerical rating given in the following Table (Table III) reflects the range of values obtained in the three tests.

Part B: In this Part of Example 3, cotton/polyester ("C/PE") and 100% polyester ("PE") fabric samples with depleted or negligible waterproofing and oil-repellent properties were immersed in a bath or tank containing a large volume of water and the PROTEX$^{AD}$ fluoroacrylate copolymer emulsion (see Example 1, Parts B and C); the five different levels of emulsion were the same as in Examples 1 and 2. The drying temperature was determined by the standard dryer setting, as in Part B of Examples 1 and 2.

Two tests were carried out at each percentage of emulsion in the tank. Each numerical rating given in the following Table (Table III) reflects the range of values obtained in the these two tests.

Part C: In this Part of Example 3, cotton/polyester ("C/PE") and 100% polyester ("PE") fabric samples with depleted or negligible waterproofing and oil-repellent properties were immersed in a bath or tank containing a large volume of water and PROTEX$^{AD}$ fluoroacrylate copolymer emulsion (see Example 1, Parts B and C), but this time the fabric samples were not dried under heat; they were permitted to dry at room temperature. The PROTEX$^{AD}$ emulsion levels were the same as in Examples 1 and 2 and Example 3, Parts A and B.

Two tests were carried out at each percentage of emulsion. Each numerical rating given in the following Table (Table II) reflects the range of values obtained in the these two tests.

TABLE III

OIL REPELLENCY TEST RESULTS (Example 3)

| Applied Amount*** (%) | Fabric | Ex. 3, Part A (3 Samples) | Ex. 3, Part B (2 Samples) | Ex. 3, Part C (No Heat, 2 Samples) |
|---|---|---|---|---|
| 0.25 | C/PE | 2 to 3 | 2 | 2 to 3 |
| 0.50 | C/PE | 3 to 4 | 3 | 3 |
| 1.0 | C/PE | 4 to 6 | 4 to 5 | 4 to 5 |
| 1.5 | C/PE | 5 to 6 | 5 | 6 |
| 3 | C/PE | 6 to 8 | 6 | 7 to 8 |
| 0.25 | PE | 5 | 5 | 5 |
| 0.50 | PE | 6 to 7 | 6 | 6 |
| 1.0 | PE | 7 to 8 | 7 | 6 to 7 |
| 1.5 | PE | 7 to 8 | 7 to 8 | 7 to 8 |
| 3 | PE | 8 | 8 | 8 |

***See Table I.

What is claimed is:

1. A method for restoring or enhancing the waterproofing of a previously waterproofed fabric, comprising the steps of:

A. preparing a fabric-treating aqueous medium by adding to a major amount of wash water a minor amount of an aqueous dispersion containing, dispersed therein, essentially a single particulate fluoroacrylate copolymer having repeating units of the formula I (I)

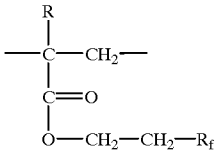

and the formula II (II)

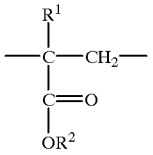

wherein $R^f$ is a fluorinated alkyl radical having 4 to 16 carbon atoms;

R is hydrogen or a $C_1$ –$C_4$-alkyl radical;

$R^1$ is the same as or different from R but is also hydrogen or a $C_1$–$C_4$-alkyl radical; and $R^2$ is hydrogen or a $C_1$–$C_8$-alkyl radical which is unsubstituted or substituted;

said aqueous dispersion further containing a minor amount of surfactant component for dispersing said polymer and maintaining said polymer in a dispersed state and for assisting the polymer in depositing on the fabric, said surfactant component containing at least one amphoteric surfactant, and a minor amount of polar organic liquid dissolved in the aqueous medium, B. immersing a previously waterproofed fabric in said fabric-treating aqueous medium for a time sufficient to deposit said aqueous dispersion on said fabric, and C. drying the thus-treated fabric at a temperature below 55° C., until the waterproofing of the fabric is restored or enhanced, without further drying at any temperature higher than 55° C.

2. A method according to claim 1, wherein $R^2$ is a $C_1$–$C_4$-alkyl radical which is unsubstituted or is substituted with a hydroxyl group.

3. A method according to claim 1, wherein said polar organic liquid is a protic compound and is present in said aqueous dispersion, prior to its addition to the wash water, in an amount ranging from 1 to 10% by weight.

4. A method according to claim 3, wherein said aqueous dispersion, prior to its addition to the wash water, consists essentially of:

a. 50 to 85% by weight of a continuous aqueous phase, b. 2 to 10% by weight of the protic organic liquid dissolved in said continuous aqueous phase, c. dispersed in said continuous aqueous phase, 15 to 40% by weight of a dispersed phase consisting essentially of a single said particulate fluoroacrylate copolymer, and d. to stabilize said dispersion, said surfactant component.

5. A method according to claim 1, wherein said particulate fluoroacrylate polymer has been obtained by co-polymerizing a monomer of the formula $$R_f—CH_2CH_2—O—(CO)—C(R)=CH_2 \quad (III)$$

and a monomer of the formula $$R^2—O—(CO)—C(R^1)=CH_2 \quad (IV)$$

in the presence of said polar organic liquid as coalescent/stabilization solvent and said surfactant component, where R, $R^1$, and $R^2$ are as defined previously, and $R_f$ is a perfluorinated alkyl radical having, on average, about 8 carbon atoms.

6. A method according to claim 5, wherein said $R_f$ is a linear perfluorinated radical that has been obtained by free-radical telomerization of tetrafluoroethylene and consists essentially of perfluorooctyl radicals.

7. A method according to claim 1, wherein said drying step is carried out under normal ambient conditions of temperature and pressure.

* * * * *